US005922521A

United States Patent [19]

Brayer et al.

[11] Patent Number: 5,922,521

[45] Date of Patent: Jul. 13, 1999

[54] UNIFORMLY MIXED DRY PHOTOGRAPHIC PROCESSING COMPOSITION AND METHOD OF PREPARATION

[75] Inventors: Franklin C. Brayer; William J. Gamble; Walter T. Gurney, all of Rochester, N.Y.

[73] Assignee: Eastman Kodak Company, Rochester, N.Y.

[21] Appl. No.: 09/048,433

[22] Filed: Mar. 26, 1998

[51] Int. Cl.[6] ..... G03C 5/38

[52] U.S. Cl. ..... 430/450

[58] Field of Search ..... 430/450

[56] References Cited

U.S. PATENT DOCUMENTS

| | | | |
|---|---|---|---|
| 3,867,151 | 2/1975 | Katz | 430/465 |
| 3,981,732 | 9/1976 | Emoto et al. | 430/465 |
| 4,029,510 | 6/1977 | Speers | 430/465 |
| 4,414,307 | 11/1983 | Kapecki et al. | 430/465 |
| 4,546,069 | 10/1985 | Libicky et al. | 430/465 |
| 4,753,869 | 6/1988 | Long et al. | 430/465 |
| 4,816,384 | 3/1989 | Fruge et al. | 430/465 |
| 4,917,992 | 4/1990 | Tirel et al. | 430/465 |
| 4,923,786 | 5/1990 | Kuhnert et al. | 430/465 |

FOREIGN PATENT DOCUMENTS 0 358 035 A3 8/1989 European Pat. Off. .

*Primary Examiner*—Hoa Van Le
*Attorney, Agent, or Firm*—J. Lanny Tucker

[57] ABSTRACT

A powdered, uniformly mixed photographic processing composition is prepared with intense mixing of dry photoprocessing chemical components, and by forming uniformly sized agglomerates of the mixed powder. During agglomeration, a solution of a binder material is applied in a controlled manner to enable the mixed powder particles to stick together but without leaving much residue in the final composition. With this process, the mixed powder and agglomerates each have desired uniformity in size and chemical composition. The resulting dry uniformly mixed composition is highly stable, dissolvable and substantially free of dust.

20 Claims, No Drawings

UNIFORMLY MIXED DRY PHOTOGRAPHIC PROCESSING COMPOSITION AND METHOD OF PREPARATION

RELATED APPLICATIONS

Commonly assigned U.S. Ser. No. 09/048,619, filed on even date herewith by Gurney, Brayer and Gamble, and entitled "Uniformly Mixed Dry Photographic Developing Composition Containing Antioxidant and Method of Preparation".

Commonly assigned U.S. Ser. No. 09/048,356, filed on even date herewith by Gamble, Gurney and Brayer, and entitled "Method of Making Uniformly Mixed Dry Photographic Processing Composition Using Hot Melt Binder".

FIELD OF THE INVENTION

This invention relates to a uniformly mixed, dry photographic processing composition, and to a method of preparing it. In particular, it relates to powdered black-and-white or color photographic processing compositions having two or more dry photoprocessing chemical components that are uniformly mixed therein.

BACKGROUND OF THE INVENTION

Conventional images are prepared from imagewise exposed photographic silver halide materials by subjecting them to one or more photographic processing solutions that include the various photochemical components necessary for providing a black-and-white and/or color image. At the very least, such materials require photochemical processing in a developer (to "develop" a silver image from exposed silver halide grains) and a fixer (to "fix" and remove unexposed silver halide). Color photographic processing requires additional steps in order to provide an acceptable dye image, for example a silver bleaching step between color development and fixing.

The various chemical formulations used in conventional photoprocessing steps have been prepared in both liquid and solid form. Many of the necessary photochemical components are already in solid form, and in early years of photography, solid processing compositions were common. However, it was often difficult to mix the solid components in a uniform fashion, and long mixing times were often then required for preparing aqueous working strength solutions. In addition, some of the photochemical components were reactive with each other, and could not be kept together without severe losses in activity, providing evidence of poor shelf life or stability.

More recently, commercial compositions have been prepared, shipped and used as aqueous solutions. Sometimes, they are provided in concentrated form in order to minimize costs associated with weight and volume, but they then require dilution upon use.

Even though concentrates provide some advantage in economy, they are usually storable for only a limited period of time, and the reduced amounts of solvent contained therein still increases shipping and storage costs. Thus, the photographic industry has long sought ways to provide stable photoprocessing formulations in dry form. Various manufacturers have developed powders, granules, solid tablets and other dry forms in recent years in response to these needs.

To date, solid compositions have not been widely accepted in the trade. One reason is that fine powdered compositions pose health risks to workers trying to formulate working solutions when the fine dust becomes airborne in the workplace. In addition, powdered chemicals are difficult to mix uniformly and consistently on a small scale, for example, in smaller photoprocessing labs. To achieve high uniformity, high energy mixing is required, and many photoprocessing customers cannot afford the needed mixing equipment or space. As the powders are made more fine, the dust problem increases and solubilization becomes more difficult.

In response to these problems, various means have been used in the industry to make powdered or granulated photochemicals, for example, fluidized bed agglomerators (see U.S. Pat. No. 4,923,786 of Kuhnert et al), extrusion processes (see U.S. Pat. No. 3,981,732 of Emoto et al), and freeze drying (U.S. Pat. No. 4,816,384 of Fruge et al).

Solid tablet chemistries have also been developed in the industry (see for example, U.S. Pat. No. 5,316,898 of Ueda et al), but the tablets lack widespread acceptance because they are more expensive than conventional photochemical compositions.

Clearly, there is a need in the art for dry, uniformly mixed photoprocessing compositions that are affordable, easy and safe to use, and readily prepared using readily available equipment and procedures. This invention is directed to solving these problems and meeting these needs.

SUMMARY OF THE INVENTION

The present invention provides a powdered, uniformly-mixed photographic processing composition comprising two or more photoprocessing chemical components, wherein:

less than 0.2 weight % of the composition is composed of agglomerates having a diameter of less than 20 $\mu$m, and the composition has less than 1 weight % solvent.

This composition can be prepared using a method comprising the steps of, in order:

A) mixing two or more dry photoprocessing chemical components to form a dry uniform mixture thereof, the mixing being carried out sufficient to provide an aim uniformity of the two or more dry photoprocessing chemical components, the aim uniformity being present when two or more random, same-size samples of the dry uniform mixture are within ±4% of the aim weight % for each photoprocessing chemical component, and B) forming agglomerates of an aim size by agglomerating the dry uniform mixture while simultaneously applying to it a binder solution comprising at least 5 weight % of a binder material, the binder solution application being carried out under conditions to provide agglomerates of the aim size, the agglomerates also having the aim uniformity, and the amount of the binder material in the resulting powdered uniformly mixed photographic processing composition is less than 3 weight %.

The present invention can be readily carried out using commercially available equipment to produce highly uniform photographic processing compositions containing photochemicals in uniformly sized and mixed agglomerates. The resulting agglomerates are large enough to avoid a dust problem, but are small enough to be readily soluble when the working solutions are made. The powdered compositions may contain all or some of the components that are needed for a given processing bath. Thus, the compositions can form a single-part photoprocessing kit, or be one component of a multi-part photoprocessing kit.

The agglomerates (or powder particles) within the composition of this invention are free-flowing, readily stored and metered into aqueous solutions, relatively inexpensive, readily soluble in water, and stable during shipping and storage.

These advantages are achieved by the unique combination of manufacturing steps and conditions described herein. While the specific equipment used in the method of this invention is not new, it has not heretofore been used to provide the photoprocessing compositions with the requisite properties of this invention. Specifically, the dry photoprocessing chemical components are mixed in such a manner using specific equipment to meet an "aim" uniformity required for a given composition, so that samples within the composition are substantially the same in composition and desired proportion of the chemical components. That is, randomly obtained samples of the composition vary in composition by no more than ±4% of a specific or "aim" weight % of the components needed for that composition.

By "aim weight %" is meant that, for a given photoprocessing composition, there is a desired or aim formulation with specific desired or aim amounts (for example, weight %) of each photoprocessing chemical component. Thus, each photoprocessing chemical component should be within that composition at a specific aim weight %, and the present invention provides formulations wherein the components are present within ±4% of the aim weight % for each component.

Once the uniform mixture is obtained, its particles are agglomerated while a binder solution is applied to achieve an aim size of agglomerates without losing the aim uniformity achieved during the mixing step. The various details for practicing these steps are provided below with exemplary conditions, equipment and procedures.

DETAILED DESCRIPTION OF THE INVENTION

The powdered, uniformly mixed photographic processing compositions of this invention comprise at least two dry photoprocessing chemical components, and may include up to 15 such components for the more complicated photoprocessing steps (for example, color development). All of these chemical components are uniformly mixed, meaning that for a given composition, an "aim uniformity" is met during the mixing step (described below).

As used herein, "photochemicals" and "photoprocessing chemical components" are used interchangeably to mean chemical materials or compounds that directly or indirectly affect the performance of a particular photoprocessing step, to provide a desired image in an exposed photographic element.

The photoprocessing chemical components are generally supplied for mixing in a suitable dry form, either powder or granules, and can be supplied as single or multiple parts. Usually, multiple formulation "parts" are used when some of the chemical components are not readily compatible with each other.

By "aim uniformity" is meant that when two or more random, same-size samples of the dry mixture are analyzed, the samples have substantially the same aim weight % of each of the various photoprocessing chemical components therein, that is within ±4% of that aim weight %, and preferably within ±2%, and more preferably within ±1%, of that aim weight %. The "aim weight %" is determined by the activity and properties desired for a given composition. For example, the aim weight % for each of the components of a developer composition will likely be different than that for each component included within a fixing composition. One skilled in the art can readily ascertain what aim weight % would be appropriate for a given component of a given composition. Thus, uniformity of chemical composition and effectiveness is insured throughout the composition.

Such high uniformity is achieved by intensive mixing of the photoprocessing chemical components (or various formulation parts) in a suitable piece of equipment. One suitable means for such intensive mixing is what is known as a "V-blender" that is commercially available from such sources as Patterson Company and Patterson-Kelly Company. This "V-blender" may also include internal baffles or "intensifier components" or "bars" that make the mixing more intense, that is, impart more shear to the mixing operation.

Uniform mixing may be also possible using a double cone blender with an intensifier bar.

The key to such mixing is to have sufficiently high shear for a sufficient time to achieve the uniformity noted above. The uniformity can be evaluated during the mixing operation, if desired, by taking random, same-size samples and analyzing them for the weight ratios of various photoprocessing chemical components. A skilled photochemist would have a desired weight % in mind for the various components based on their activity and use in photoprocessing. If the random samples are within the required variations (e.g. ±4% of aim weight %), then uniform mixing has been accomplished. If the two samples are outside the required variations, additional mixing time is required. After routine experimentation, the suitable mixing times and conditions would be readily determined and used for future mixing operations. Suitable mixing times will also vary depending upon the specific equipment used, but may be as little as 10 minutes and up to several hours.

Another benefit of such intense mixing is a uniform size distribution. Preferably, the powder particles produced from the mixing have an average diameter of from about 40 to about 80 μm. This uniform size distribution contributes to the uniformity of the resulting agglomerates formed after mixing.

Specific equipment and procedures for mixing are described below in the examples.

Following the intense mixing noted above, the powder particles are agglomerated into larger particles that are uniform in size and composition. These agglomerates have an average diameter generally of more than 20 μm, and preferably of more than 100 μm. Thus, no more than 0.2 weight % of the powdered composition is composed of particles or agglomerates that are less than 20 μm in size.

On the other end of the scale, the agglomerates are generally no larger than 1000 μm, and preferably less than 900 μm. A preferred range of agglomerate aim sizes is from about 125 to about 850 μm for at least 95% of the agglomerates. No more than 1% of the total dry composition weight is composed of agglomerates having a size of 1000 μm or more.

Each agglomerate has the same uniformity in aim weight % of photochemicals (that is "aim uniformity") achieved in the intense mixing step.

Agglomeration can be carried out using conventional agglomerating equipment such as a disk pellitizer that can be obtained from a number of commercial sources (including Ferro-Tech Company and Teledyne-Read Co.). Alternatively, agglomeration can be achieved using a "rolling plane" pelletizer, such as those commercially available from same commercial sources. The particular conditions and procedures for using such equipment would be readily apparent from the instructions provided with the equipment, and could be modified as described herein to achieve the desired result in agglomerate size and uniformity. Specific procedures and equipment are described below in Example 1. For example, in a rolling plane pelletizer, adjusting the rotation speed and angle of the pan can be used to control the size of the agglomerates.

During agglomeration, the dry mixture is contacted (for example, sprayed) with a liquid mixture or dispersion of a binder material that, upon drying, effectively adheres mixture particles together to form the agglomerates. The binder solution comprises generally at least 5, and preferably at least 20, and generally less than 25 weight %, of the binder material.

The useful binder materials must be soluble or dispersible in water or any suitable polar organic solvent (such as lower alcohols, tetrahydrofuran, acetone and methyl ethyl ketone). Preferably, the solvent is water, and the binder materials are water-soluble or -dispersible hydrophilic colloids or low molecular weight polymers (both naturally occurring and synthetically prepared). Representative binder materials include, but are not limited to, acacia gum, agar, corn starch, polyvinyl alcohol, gelatin and gelatin derivatives, hydrophilic cellulose derivatives (for example, carboxymethyl cellulose, hydroxypropylmethyl cellulose and ethyl cellulose), mono- and polysaccharides (such as sucrose, fructose, dextran and maltodextrin), mannitol, sorbitol, gum arabic, guar gum, karaya gum, agarose, polyvinyl pyrrolidone and acrylamide polymers. Acacia gum, polyvinyl alcohol and gelatin are preferred, and acacia gum is most preferred.

It is important that there not be too little or too much binder material in the resulting dry composition of this invention. If there is too little binder material, the agglomerates will likely be too small and composition "dust" will be a problem. If there is too much binder material, the agglomerate size will be too large and there will likely be less uniformity of the photoprocessing chemical components. Generally, the amount of binder material in the finished dry composition should be at least 0.25, and preferably at least 0.5, weight %, and generally no more than 3 and preferably no more than 1, weight %, based on total dry composition weight.

In some instances, an antioxidant (or preservative) can be included in the binder solution, or separately applied to the uniform mixture, in order to prevent oxidation of photoprocessing chemical components in the composition. Useful antioxidants include both inorganic sulfites, and organic compounds such as hydroxylamine and hydroxylamine derivatives (such as mono- and dialkylhydroxylamines), hydrazines and other materials known in the art for this purpose. Sulfites are particularly useful for this purpose when preparing certain photoprocessing compositions such as black & white and color developers, as described in more detail in copending and commonly assigned U.S. Ser. No. 09/048,619, of Gurney et al, identified above.

It is also important for composition stability that the final dry composition of this invention comprise no more than 1%, preferably no more than 0.5%, of solvent based on total composition weight. This may require a drying step after the formation of the agglomerates, using suitable drying equipment and conditions that will not adversely affect the photoprocessing chemical components in the composition.

It is also an important feature of the dry processing compositions of this invention that they be readily dissolvable in water so they can be used immediately in photographic processes with minimum mixing or agitation. Dissolvability can be determined by observing if a 1 g sample of the composition will dissolve within 120 seconds in 100 g of water at ambient temperature while being stirred at 350 rpm with a 1 inch (2.54 cm) stirring bar. Faster dissolution is more desirable. In some instances, dissolvability can be enhanced by the presence of additional "parts" of a multi-part photoprocessing kit.

The dry photographic processing compositions of this invention can be the sole compositions needed for a given processing step, or they can be one part of a multi-part photographic processing kit that includes two or more dry or liquid components that are mixed in order to carry out a given processing step.

The compositions can include photographic developer compositions (either black & white or color), bleaching compositions, bleach-fixing compositions, fixing compositions, dye image stabilizing compositions, or any other composition can may be useful for providing images in black & white or color negative or reversal films or papers, motion picture films or prints, radiographic films, graphic arts films, or any other photographic silver halide imageable material.

The chemical components and layer structures of such materials are well known, for example as described for example, in *Research Disclosure,* publication 38957, pages 592–639 (September 1996), and the many publications listed therein. *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*".

The various photoprocessing chemical components needed for the various processing compositions of this invention are also well known, as described in the noted *Research Disclosure* and publications noted therein.

For example, black & white developer compositions generally include one or more developing agents including, but not limited to dihydroxybenzene developing agents, and ascorbic acid (and derivatives thereof). Such materials are well known in the art, for example, in U.S. Pat. No. 4,269,929 (Nothnagle) and U.S. Pat. No. 5,702,875 (Opitz et al), both incorporated herein by reference. Hydroquinone is the preferred dihydroxybenzene developing agent, and ascorbic acid is a preferred ascorbic acid type developing agent.

The developer compositions generally also include one or more co-developing agents (also known as auxiliary or super-additive developing agents), such as the preferred 3-pyrazolidone compounds (also known as "phenidone" type compounds) described in U.S. Pat. No. 5,264,323 (Purol et al), incorporated herein by reference, as well as in Opitz et al noted above. Other common components include antioxidants (such as sulfites), buffers (such as carbonates and borates), antifoggants, surfactants, anti-sludging agents, and metal ion chelating agents. Other details of black and white developer compositions are provided in *Research Disclosure,* Section XIX.

Color developer compositions are also well known. They generally include one or more color developing agents (such as primary aromatic amino color developing agents including p-phenylenediamines) as described for example in U.S. Pat. No. 4,892,804 (Vincent et al) and *Research Disclosure,* Section XIX. Such compositions also generally include one or more antioxidants (or preservatives) such as sulfites and hydroxylamines as described above, antifoggants, metal ion chelating agents (also known as sequestering agents), surfactants, buffers, biocides or anti-fungal agents, anti-sludging agents, optical brighteners (or stain-reducing agents), water-solubilizing agents, development accelerators, and other components known to one skilled in the art, as described in *Research Disclosure,* Section XIX, noted above.

Bleaching, bleach-fixing and fixing solutions are generally used after development of photographic materials, and the components of such solutions are well known, as described in *Research Disclosure* Section XX. Bleaching and bleach-fixing solutions generally contain one or more bleaching agents and/or fixing agents. Bleaching agents include peroxides, periodates, persulfates, metal (such as ferric) salts and complexes of carboxylic acids. Fixing agents can include thiosulfates, thiocyanates and other compounds that solubilize silver halide in the photographic material. Such solutions can also include rehalogenating agents, buffers, metal ion chelating agents, biocides, bleaching accelerators, fixing accelerators and other components well known to a skilled worker in the art.

Stabilizing solutions are also known from *Research Disclosure,* noted above. They may include one or more surfactants, dye image stabilizing compounds, metal ion chelating agents, optical brightening compounds, stain-reducing compounds, anti-scumming agents, biocides, buffers and other components known to a skilled artisan.

For all of the compositions of this invention, a skilled artisan would know the various amounts of photoprocessing chemical components to be mixed in a given composition for a given photoprocessing purpose. An important aspect of this invention is that, for a given composition, the mixing and agglomeration steps provide desired uniformity of the photoprocessing chemical components consistent with desired "aim weight %" of each chemical component.

The various examples shown below are representative of several of the dry photographic processing compositions of this invention. Some of them are prepared as "single-part" compositions while others are included as multi-part photoprocessing kits.

EXAMPLE 1

Preparation of Black & White Radiographic Developer

A two-part black & white developer useful for processing radiographic films was prepared in the following manner. Each "part" was prepared as a dry powder and can be packaged as a component of a processing kit. The individual "parts" contained the following chemical components:

| | |
|---|---|
| Part A: | |
| Ascorbic acid developing agent | 6.11 kg |
| 4-Hydroxymethyl-4-methyl-1-phenyl-3-pyrazolidone | 0.477 kg |
| Benzotriazole | 0.038 kg |
| Potassium bromide (powdered) | 0.764 kg |
| Sodium sulfite | 7.6 kg |
| Diethylenetriaminepentaacetic acid, pentasodium salt | 0.328 kg |
| Part B: | |
| Potassium carbonate buffer | |

Part A was mixed for 20 minutes under ambient conditions in a commercially available V-blender (Patterson-Kelly Company) containing a disintegrator (or intensifier), at 16 rpm for the shell and 2300 rpm for the disintegrator. The resulting highly mixed powder was then introduced to a commercially available Ferro-Tech rolling plane pelletizer, where agglomeration was carried out under ambient conditions for 30 minutes. During agglomeration, a 15% aqueous solution (by weight) of acacia gum was sprayed into the pelletizer at a rate of about 10 ml/min. This binder solution also contained about 15 weight % of sodium sulfite as an antioxidant.

After drying the agglomerates at 25° C. for about 6 hours, random samples were determined to have the desired uniformity of chemical components (within ±2% of the aim weight %), and no more than 0.2 weight % of the composition consisted of agglomerates or particles having a diameter of less than 20 $\mu$m, and less than 1 weight % were composed of agglomerates having a diameter greater than 1000 $\mu$m. The resulting agglomerates contained less than 3 weight % of acacia gum, based on total composition weight.

EXAMPLE 2

Preparation of Hydroquinone Black & White Developer

Another two-part black & white developer useful for processing radiographic films was prepared in the following manner. Each "part" was prepared as a dry powder and can be packaged as a component of a processing kit. The individual "parts" contained the following chemical components:

| | |
|---|---|
| Part A: | |
| Hydroquinone developing agent | 4.856 kg |
| Hydroxymethyl-4-methyl-1-phenyl-3-pyrazolidone | 259.06 g |
| 5-Methylbenzotriazole | 34.33 g |
| Potassium bromide (powdered) | 970.68 g |
| Sodium sulfite | 9.241 kg |
| Propylenediaminetetraacetic acid | 243.45 g |
| Part B: | |
| Potassium carbonate buffer | |

Part A was mixed, agglomerated and dried as described in Example 1. After drying, the agglomerates were determined to have the desired uniformity of chemical components (within ±2% of the aim weight %), and no more than 0.2 weight % of the composition consisted of agglomerates or particles having a diameter of less than 20 $\mu$m, and less than 1 weight % were composed of agglomerates having a diameter greater than 1000 $\mu$m. The resulting agglomerates contained less than 3 weight % of acacia gum, based on total composition weight.

EXAMPLE 3

Preparation of Color Developer

A three-part color developer useful for processing color negative films was prepared in the following manner. Each "part" was prepared as a dry powder and can be packaged as a component of a processing kit. The individual "parts" contained the following chemical components:

| | |
|---|---|
| Part A: | |
| CD4 color developing agent* | 4.189 kg |
| Hydroxylamine sulfate antioxidant | 2.47 kg |
| Sodium sulfite | 3.429 kg |

-continued

| | |
|---|---|
| Sodium bromide | 175.397 g |
| Propylenediaminetetraacetic acid | 2.414 kg |
| Part B: | |
| Potassium bicarbonate buffer | |
| Part C: | |
| Potassium carbonate buffer | |

*CD4 is 4-(N-ethyl-N-β-hydroxyethylamino)-2-methylaniline sulfate

Part A was mixed and agglomerated using the equipment and procedures described in Example 1 with similar good results.

EXAMPLE 4

Preparation of Ammonium Fixing Composition

A black & white film fixing composition was prepared as a single-part composition in the following manner with the following chemical components:

| | |
|---|---|
| Ammonium thiosulfate | 4.617 kg |
| Tetrasodium ethylenediamine tetraacetic acid | 49 g |
| Sodium sulfite | 930 g |
| Citric acid | 634 g |
| Ammonium thiocyanate | 5.684 kg |

This formulation was mixed and agglomerated using the procedures and equipment described in Example 1 with good results.

EXAMPLE 5

Preparation of Sodium Fixing Composition

A sodium based fixing composition was similarly prepared having the following components:

| | |
|---|---|
| Sodium thiosulfate | 14.37 kg |
| Sodium tetraborate, pentahydrate | 151 g |
| Sodium metabisulfite | 1.216 kg |
| Sodium citrate, dihydrate | 81 g |
| Ammonium alum sulfate, dodecahydrate | 2.437 kg |
| Boric anhydride (60 mesh) | 202 g |
| Citric acid, anhydrous | 72 g |
| Sodium acetate, anhydrous | 1.467 kg |

This formulation was mixed and agglomerated using the procedures and equipment described in Example 1 with good results.

EXAMPLE 6

Preparation of Alternative Fixing Composition

An alternative sodium based fixing composition was prepared as follows using the following components:

| | |
|---|---|
| Sodium thiosulfate | 7.174 kg |
| Sodium sulfite | 1.355 kg |
| Sodium bisulfite | 576 g |
| Tetrasodium ethylenediaminetetraacetic acid, dihydrate | 720 g |
| Sodium thiocyanate | 8.818 kg |

This formulation was mixed and agglomerated using the procedures and equipment described in Example 1 with good results. As the sodium thiocyanate was very hard before mixing, it may be useful to grinding it before mixing.

EXAMPLE 7

Preparation of Bleach-fixing Composition

A bleach-fixing composition useful for processing color photographic paper was prepared using the following components:

| | |
|---|---|
| Sodium thiosulfate | 9.01 kg |
| Sodium sulfite | 2.14 kg |
| Sodium bisuifite | 2.42 kg |
| Sodium ferric ethylenediaminetetraacetic acid | 5.91 kg |

This formulation was mixed and agglomerated as described in Example 1 with similar good results.

The invention has been described in detail with particular reference to preferred embodiments thereof, but it will be understood that variations and modifications can be effected within the spirit and scope of the invention.

We claim:

1. A method of preparing a powdered, uniformly-mixed photographic processing composition comprising two or more photoprocessing chemical components, wherein:

less than 0.2 weight % of said powdered, uniformly mixed photographic processing composition is composed of agglomerates having a diameter of less than 20 $\mu$m, and said composition has less than 1 weight % solvent, said method comprising the steps of, in order:

A) mixing two or more dry photoprocessing chemical components to form a dry uniform mixture thereof, said mixing being carried out sufficient to provide an aim uniformity of said two or more dry photoprocessing chemical components, said aim uniformity being present when two or more random, same-size samples of said dry uniform mixture are within ±4% of the aim weight % for each of said dry photoprocessing chemical components, and B) forming agglomerates of an aim size by agglomerating said dry uniform mixture while simultaneously applying to it a binder solution comprising at least 5 weight % of a binder material, said binder solution application being carried out under conditions to provide agglomerates of said aim size, said agglomerates also having said aim uniformity, and the amount of said binder material in the resulting powdered uniformly mixed photographic processing composition is less than 3 weight %.

2. The method of claim 1 further comprising drying said agglomerates formed in step B.

3. The method of claim 1 wherein said aim uniformity is present when two or more random, same-size samples of said dry uniform mixture are within ±2 % of the aim weight % for each of said dry photoprocessing chemical components.

4. The method of claim 1 wherein said binder solution is an aqueous solution containing a water-soluble or water-dispersible hydrophilic binder material.

5. The method of claim 4 wherein said binder material is acacia gum, polyvinyl alcohol or a gelatin.

6. The method of claim 5 wherein said binder material is acacia gum.

7. The method of claim 1 wherein said binder solution comprises from about 5 to about 25 weight % of said binder material.

8. The method of claim 7 wherein said binder solution comprises from about 20 to about 25 weight % of said binder material.

9. The method of claim 1 wherein said powdered uniformly mixed photographic processing composition comprises from about 0.25 to about 3 weight % of said binder material.

10. The method of claim 9 wherein said powdered uniformly mixed photographic processing composition comprises from about 0.5 to about 1 weight % of said binder material.

11. The method of claim 1 wherein no more than 1 weight % of said powdered uniformly mixed photographic processing composition is comprised of agglomerates having a diameter greater than 1000 $\mu$m.

12. The method of claim 1 wherein at least 95% of said agglomerates have a diameter of an aim size of from about 125 to about 850 $\mu$m.

13. The method of claim 1 wherein said composition has less than 0.5 weight % solvent.

14. The method of claim 1 wherein 1 g of said powdered uniformly mixed photographic processing composition will dissolve within 120 seconds, in 100 g of water at ambient temperature while being stirred at 350 rpm with a 1 inch stirring rod.

15. The method of claim 1 wherein step B is carried out using a disk pelletizer.

16. The method of claim 1 wherein step B is carried out using a rolling plane pelletizer.

17. The method of claim 1 wherein said mixing in step A is carried out using a V-blender having an intensifier component.

18. The method of claim 1 for preparing a dry bleaching or bleach-fixing composition.

19. The method of claim 1 for preparing a dry fixing composition.

20. The method of claim 1 wherein said two or more photoprocessing chemical components are provided for mixing in two or more separate dry compositions.

* * * * *